US005735080A

United States Patent [19]

Pratolongo

[11] Patent Number: 5,735,080

[45] Date of Patent: Apr. 7, 1998

[54] PERFECTED MOTION DEVICE TO OPEN AND CLOSE A WARDROBE DOOR

[76] Inventor: Modesto Pratolongo, 11, Via Ravizza, Milano, Italy

[21] Appl. No.: 643,588

[22] Filed: May 6, 1996

[30] Foreign Application Priority Data

May 9, 1995 [IT] Italy ..... MI95A0920

[51] Int. Cl.[6] ..... E05D 15/10

[52] U.S. Cl. ..... 49/209; 49/248; 312/325; 312/326

[58] Field of Search ..... 49/208, 209, 247, 49/248, 249, 253; 312/109, 138.1, 300, 312, 325, 326

[56] References Cited

U.S. PATENT DOCUMENTS 2,170,098 1/1939 Stephenson ..... 312/325 X
4,917,446 4/1990 Mariani ..... 312/325

FOREIGN PATENT DOCUMENTS 318747 1/1957 Denmark ..... 49/110
1584130 4/1969 Germany ..... 49/248
741432 12/1955 United Kingdom ..... 49/248

*Primary Examiner*—Jerry Redman
*Attorney, Agent, or Firm*—Keil & Weinkauf

[57] ABSTRACT

A rigid bearing staff, substantially C shaped, the central element of which is hinged along the axis passing within the thickness of a wall of a wardrobe, fitted with two arms the free ends of which are rotatingly linked to two opposite pins anchored to end of the medial axis, or quasi medial axis, lying in the internal part of a door to be governed, while two other arms, next to an appropriate distance from and to one side only common to the previous ones to which they are parallel and of equal length, have their four ends rotatingly linked to other two axes again parallel to the previous ones and located one in the rigid structure of the wardrobe and the other along the inside of the same door: all this constitutes the functional design of two articulated parallelogram hinges, superimposed and distanced, rigidly and directly linked and invisible inside and on all external sides of a wardrobe.

8 Claims, 2 Drawing Sheets

PERFECTED MOTION DEVICE TO OPEN AND CLOSE A WARDROBE DOOR

BACKGROUND OF THE INVENTION

The present invention concerns a perfected motion device to open and close a wardrobe door.

As it is known, so called "flush" doors, within which the invention is set, have the advantage, compared to sliding doors, of a better dust-sealing because their perimeter plane adheres and fits into the borders of the fixed structures of a wardrobe. However they feature the drawback of having a width limited by their open dimensions and that they exclusively bear upon their hinges at an overhang.

Also in order to overcome these limits "parallelogram" opening systems have been proposed, substantially consisting of two large quadrilateral articulate hinges preferably located one under the lower plate and the other above the top plate of a wardrobe, thus obtaining both the sealing of the closure and very limited open dimensions.

However, these systems feature the drawback of being subjected to oscillating shaking of the door plane during motion, because, generally, the two superimposed hinges are not rigidly linked to one another. But, in order to perform this link in a direct manner, that is with no mechanical connections or other, the only solution known at the state of the art, is to pass a transmission shaft within the wardrobe seriously jeopardizing its functions.

BRIEF SUMMARY OF THE INVENTION

The main purpose of the present invention is to realize a rigid and direct connection between said two superimposed hinges, solidly linking at least two specular pins by means of a transmission shaft that however does not pass through the useful space of a wardrobe but instead lies rotatingly supported within the thickness of a wall of the same wardrobe and hence is invisible from the useful space inside as it is from all the external sides of the wardrobe. Another important purpose of the invention concerns the type of construction that, being performed within a factory does not require, during the assembly stage on location, specialized work that is difficult to come by.

As an example only, a possible embodiment of the device for the government of wardrobe doors according to the present invention is described and illustrated below by the attached drawings, in which;

DETAILED DESCRIPTION OF THE DRAWINGS

Figure 4:
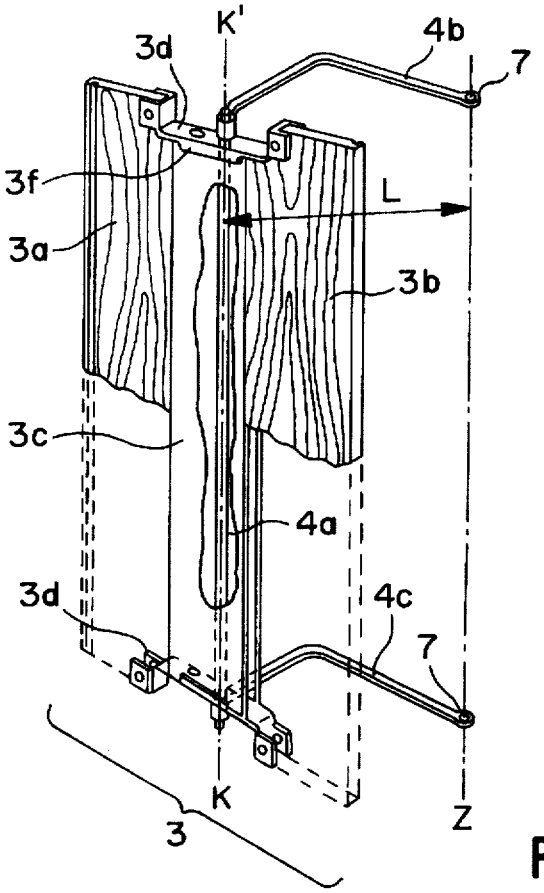
FIG. 4 shows the elements in FIG. 3 relative to the side assembled. This side contains and rotatingly supports the central part of a staff 4*a* in a [ shape the arms 4*b*–4*c* of which appear to be bent in order to allow the door full opening (refer to FIG. 1).

With reference to the drawings mentioned, in FIG. 4 the assembled side 3 is shown, comprising the following elements (also visible in the other figures): back half-side 3*a*; front half-side 3*b*; hollow connecting element 3*c* for the two half-sides, preferably wiredrawn; two opposite support caps 3*d*, fitted onto the ends of the hollow element 3*c*, and embedded and bolted (by means of screws 5) to the half-sides 3*a*–3*b*. In both said elements 3*d* both the flaps 3*f* are made, and the seats S that are the rotating link to staff 4*a*.

Figure 2:
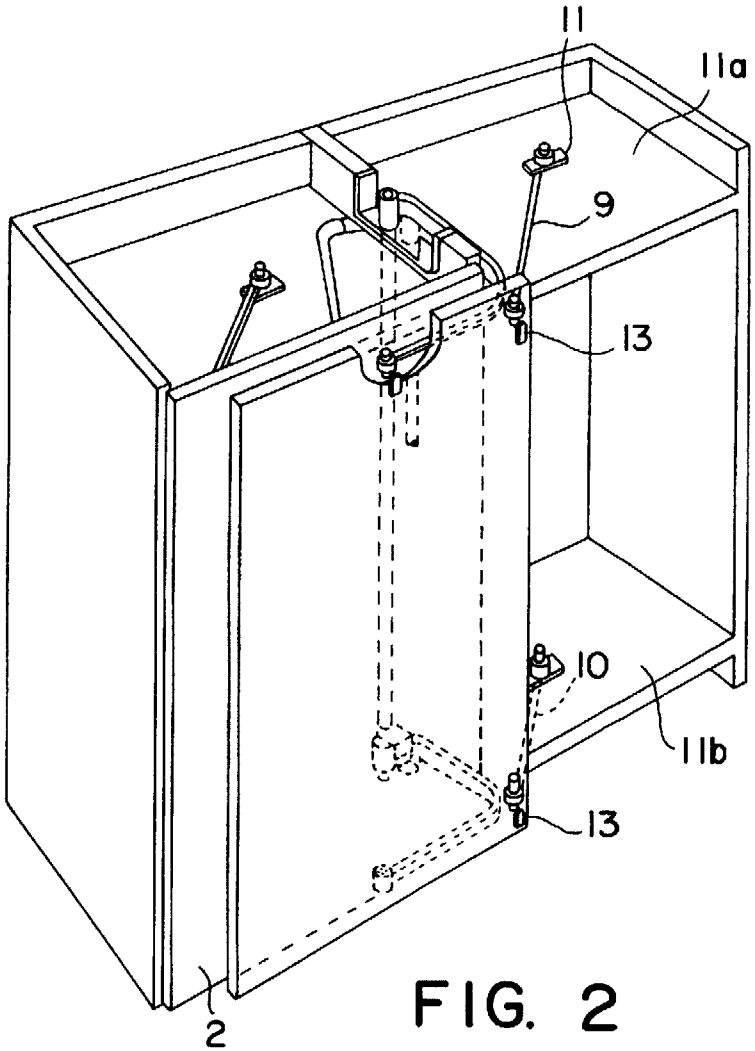
FIG. 2 is a view of the same wardrobe as in FIG. 1 in which the right hand door is shown as open and superimposed on the closed one, and this situation is mutually possible.
Figure 1:
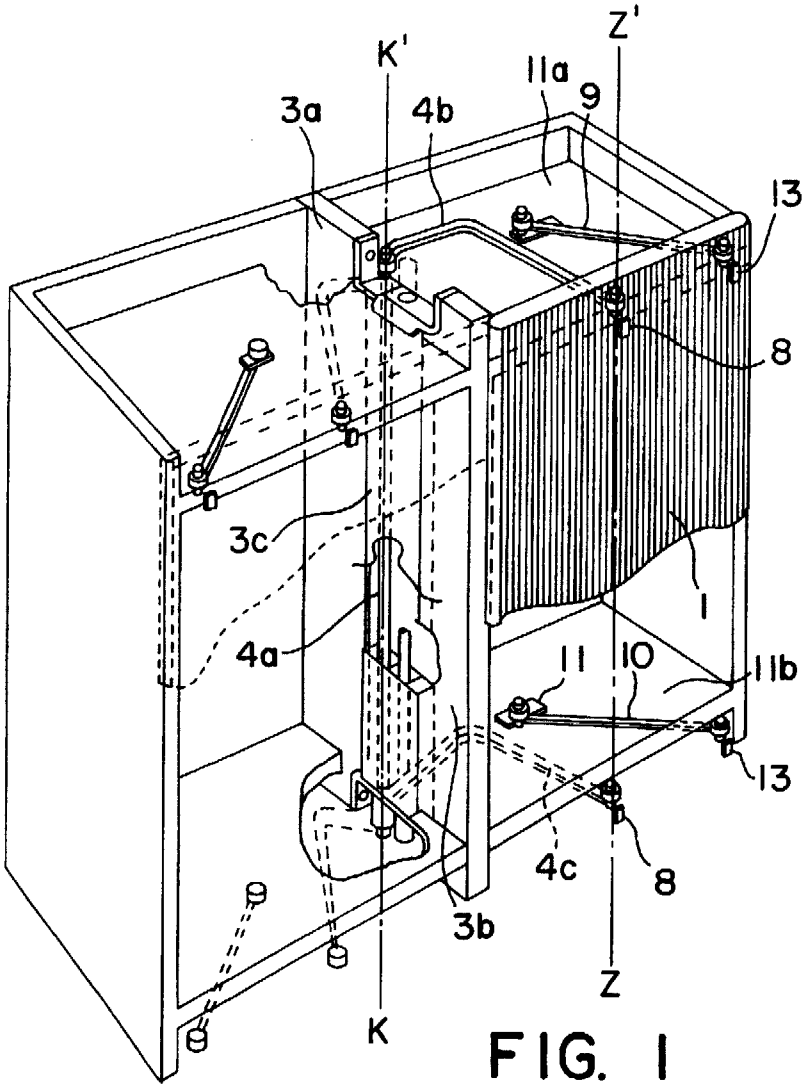
FIG. 1 is a perspective view of a two door wardrobe fitted with the motion device subject of the present invention.
Figure 3:
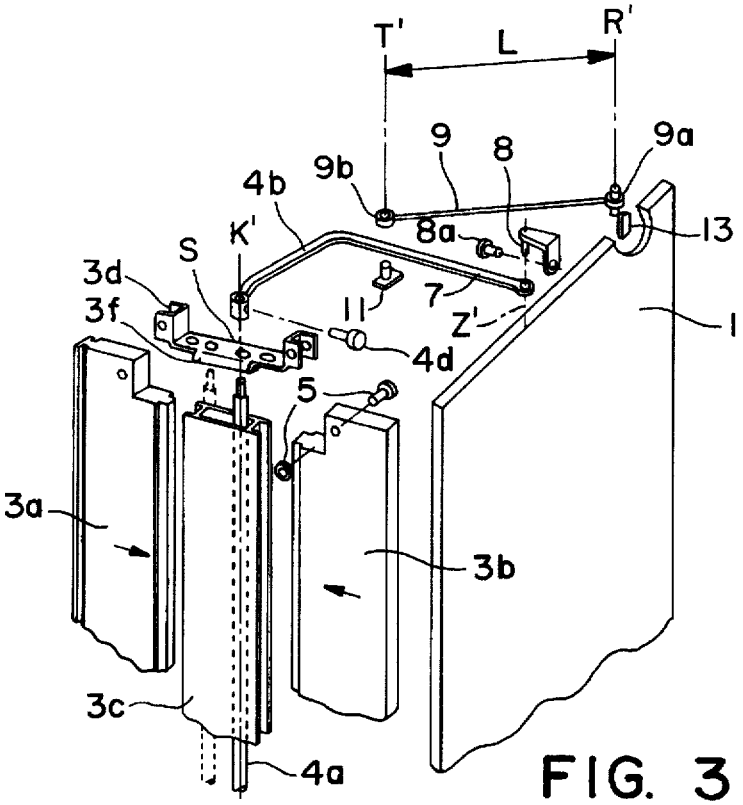
FIG. 3 is a blow-up perspective of the component elements of the upper part of the cinematic subject of the present invention, and the lower part is the same and specular to the one illustrated.

Staff 4*a* in FIG. 4 consists of three bodies solidly connected by means of thrust-screws 4*d*. The central body 4*a* is rotatingly linked to seats S of supports 3*d*, while the free ends of arms 4*b*–4*c* are fitted with seats 7, suited to being rotatingly linked to support pins 8 bolted to the door with screws 8*a*. Door 1 is thus hinged both on the z–z' axis that passes through the half-line, and along the k–k' axis that lies within the assembled side 3, that consists of three elements 3*a*, 3*b*, and 3*c* embedded into one another. In FIGS. 1, 2, 3 the other two levers 9 and 10 are shown set next to a common side, that is parallel and on the same plane, respectively with arms 4*b* and 4*c* of which they feature the same length L. These levers 9 and 10 have their ends rotatingly linked to support pins 13, that are solid with door 1, and with support pins 11 fixed to the two end plates 11*a* and 11*b*. Note that levers 9 and 10 have no bearing function because the weight of the door bears only upon the arms of staff 4*a*. However they functionally complete and constitute, together with arms 4*b*–4*c*, a system of two superimposed parallelograms, rigidly linked in their common hinging axis k–k' hence the system is suited to ensuring the motion of the door in absolute absence of lateral shaking and clearly harmonic with the aesthetics of the unit, given that the shaft 4*a* is invisible. With the description of the functional structure the motion device proposed is determined and the invention achieves its purposes.

I claim:

1. A wardrobe having outer and inner walls and doors, said wardrobe further having a device for opening and closing said doors, said device comprising:

a rigid bearing staff which is substantially C-shaped, having a central element which is hinged along an axis passing within a thickness of one of said inner and outer walls of the wardrobe, said rigid bearing staff having two arms, each arm having a free end which is rotatingly linked to a pin anchored to an end of the rigid bearing staff, said device further comprising two levers which are parallel to said arms and which are in a same plane as said arms, said levers having first and second ends, said levers having their first ends rotatingly linked to support pins on one of said wardrobe doors, and having their second ends rotatingly linked to one of said inner walls of the wardrobe, thereby forming a functional design of two articulated parallelogram hinges which are superimposed and distanced, rigidly and directly linked and invisible inside and on all external sides of said wardrobe.

2. A device according to claim 1 characterized in that one of the outer and inner walls in which the rigid staff is fitted is formed by more elements embedded into one another.

3. A device according to claim 2, characterized in that one of the outer and inner walls in which the staff passes has a hollow, closed, cross section.

4. A device according to claim 1, characterized in that one of the outer and inner walls in which the rigid staff passes has a hollow, open, cross section thereby forming a hollow section side.

5. A device according to claim 4, characterized in that one of the outer and inner walls of the hollow section side is set up to support more than one staff, in order to allow movement of more doors of the wardrobe.

6. A device according to claim 4 characterized in that a wall of the hollow section side is constituted by a tubular element that can be embedded into an element that makes up the hollow section side.

7. A device according to claim 6 characterized in that the tubular element is set up to fit its two ends into two supports rotatingly bearing the staff, the supports solidly linking the element making up the side.

8. A device according to claim 1 characterized in that the rigid bearing staff can be disassembled, and has at least one arm radially orientated on a central axis, and fastened by means of a thrust-screw.

* * * * *